United States Patent [19]

Kim et al.

[11] Patent Number: 4,927,342

[45] Date of Patent: May 22, 1990

[54] COMPRESSOR NOISE ATTENUATION USING BRANCH TYPE RESONATOR

[75] Inventors: Jeung T. Kim; Imdad Imam, both of Schenectady, N.Y.

[73] Assignee: General Electric Company, Schenectady, N.Y.

[21] Appl. No.: 282,784

[22] Filed: Dec. 12, 1988

[51] Int. Cl.[5] ..... F04C 18/356; F04C 29/06

[52] U.S. Cl. ..... 418/63; 418/181; 181/403

[58] Field of Search ..... 418/63, 181; 417/312; 181/240, 250, 266, 276, 403

[56] References Cited

U.S. PATENT DOCUMENTS 4,427,351 1/1984 Sano ..... 418/63

FOREIGN PATENT DOCUMENTS 61-192892 8/1986 Japan ..... 418/181
63-230980 9/1988 Japan ..... 417/312

OTHER PUBLICATIONS

Sano et al., 1984 International Compressor Engineering Conference, "Analysis of Hermetic Rolling Piston Type Compressor Noise, and Countermeasures", pp. 242–250, 1984.

*Primary Examiner*—John J. Vrablik
*Attorney, Agent, or Firm*—Paul R. Webb, II; James C. Davis, Jr.

[57] ABSTRACT

A Helmholtz resonator is used in communication with the compression chamber of a rotary compressor in order to attenuate noise. The resonator concentrates the attenuation of noise in a frequency band around 4 kHz corresponding to the concentration of noise produced by a particular rotary compressor, this band also corresponding to the frequencies which the human ears are most sensitive to. The resonator branches off from the discharge port in an end wall of the compressor. The resonantor uses an easily machined cylindrical resonance cavity on the surface of the end wall, the resonance cavity also being bounded on one side by a cylindrical wall of the rotary compressor. The resonator significantly reduces the noise in a rotary compressor of a specific type commonly used for compressing refrigerant gases in a refrigerator.

20 Claims, 7 Drawing Sheets

| PARAMETERS | | FREQUENCY ($KH_z$) | | | | | | | | |
|---|---|---|---|---|---|---|---|---|---|---|
| $\sqrt{Vol}$ | $\sqrt{\frac{S_b}{\ell}}$ | 2.0 | 2.5 | 3.0 | 3.5 | 4.0 | 4.5 | 5.0 | 5.3 | 6.0 |
| 5.0 | .628 | -0.4 | -1.0 | -2.4 | -6.8 | - ∞ | -7.1 | -3.5 | -2.0 | -1.3 |
| 6.0 | 0.754 | -0.9 | -1.9 | -4.0 | -9.5 | - ∞ | -9.8 | -5.5 | -3.4 | -2.4 |
| 7.0 | 0.879 | -1.5 | -3.1 | -5.8 | -11.9 | - ∞ | -12.3 | -7.6 | -5.1 | -3.8 |
| 8.0 | 1.005 | -2.4 | -4.4 | -7.6 | -14.1 | - ∞ | -14.5 | -9.6 | -6.8 | -5.3 |
| 9.0 | 1.131 | -3.4 | -5.9 | -9.4 | -16.1 | - ∞ | -16.5 | -11.4 | -8.5 | -6.8 |
| 10.0 | 1.256 | -4.4 | -7.3 | -11.1 | -17.9 | - ∞ | -18.3 | -13.2 | -10.1 | -8.3 |

FIG. 9

| | MOD. #1 | MOD. #2 | MOD. #3 |
|---|---|---|---|
| DIAMETER OF CAVITY 34 (INCH(mm)) | .197 (5.0) | .197 (5.0) | .197 (5.0) |
| LENGTH OF CAVITY 34 (INCH(mm)) | .059 (1.5) | .096 (2.5) | .157 (4.0) |
| VOLUME OF CAVITY 34 $mm^3$ ($mm^3$) | 29.4 | 49.1 | 78.5 |

FIG. 10

COMPRESSOR NOISE ATTENUATION USING BRANCH TYPE RESONATOR

BACKGROUND OF THE INVENTION

This invention relates to a noise reduction system for a compressor. More specifically, this invention relates to use of a branch type resonator to attenuate noise from a rotary type of compressor.

Compressors often generate undesirably high levels of noise. A particular rotary type of compressor often produces high frequency noise, especially noise in a narrow frequency band around 4 kHz. Unfortunately, human ears are generally most sensitive to frequencies around 4 kHz. The high pressure compressed gas inside the chamber is generally the primary noise source.

The compressor structure is vibrated primarily by the gas pressure inside the compression chamber. In a rotary compressor having a sliding vane and the type commonly used for refrigerators, the refrigerant gas pressure reaches up to 200 psi and maximum sound pressure level (SPL) is about 120 dB. Although the commonly used discharge mufflers attenuate the direct air-borne sound energy, the pressurized gas excites the mechanical structures (cylinder and shaft) and the high vibration frequency energy arrives on the casing to produce a high sound pressure level outside of the casing.

The most efficient way of attenuating the compressor noise is controlling the compressor gas spectrum directly. Any resonator type of device built in the discharge port works as a mechanical filter. Three types of resonators might be used for trying to reduce the noise: a muffler, an orifice type of branch, and a Helmholtz type of branch.

A muffler has a different cross-sectional area in order to expand gas abruptly. During the expansion process, a muffler reflects back the high frequency sound and transmits the low frequency sound energy. A muffler can be considered as a low-pass filter. Depending upon the requirements of maintaining compressor efficiency and the frequency characteristics of a particular compressor design, a muffler may require too large a structure for suitability.

An orifice acts as a high pass filter. The operating frequency range is quite broad and the device geometry is of the order of a wavelength corresponding to the frequency. As with the muffler, the orifice type of branch may be too large compared to the size of the compressor discharge port for a particular frequency noise signal.

As the muffler and orifice may be physically too big to be implemented in a particular type of rotary compressor, the Helmholtz resonator might be used. This resonator consists of a small size hole having a volume and a branch communicating with the main pipe or branch. If the incident wave is transmitted into the resonator, the resonator reflects back the certain frequency sound and transmits other than the reflected frequency sound. This resonator functions as a band-reject filter, the rejected band corresponding to the frequency of resonance of the Helmholtz resonator.

An example of the use of a Helmholtz resonator in a compressor is described in the proceedings of the 1984 International Compressor Engineering Conference at Purdue in a paper entitled "*Analysis of Hermetic Rolling Piston Type Compressor Noise, and Countermeasures*" by Sano et al., pages 242–250. In that article, the noise of a hermetic rolling position type compressor for room air conditioners was discussed. Additionally, the use of a Helmholtz resonator for a relatively broad band of noise attenuation was shown. In order to provide the broad frequency band noise reduction, the article shows a generally oval type of cavity for the Helmholtz resonator, although the actual geometry of the Helmholtz resonator is not discussed in detail.

Although the suppression of noise in rotary compressors has been viewed as a desirable feature, consideration of size constraints, increased cost from extra machining and/or assembly operations, and other factors have generally discouraged the use of certain types of noise reduction. Additionally, the use of particular types of noise reduction techniques has been ill-suited for compressors which have concentrated noise in a particular frequency band around 4 kHz. Further, some noise reduction techniques have been limited in application because their use tends to decrease the efficiency of the compressor. That is, such techniques provide only marginal noise improvement unless the techniques are carried sufficiently far as to result in significantly diminished compressor efficiency.

OBJECTS AND SUMMARY OF THE INVENTION

Accordingly, it is a primary object of the present invention to provide a new and improved compressor design.

A more specific object of the present invention is to provide a compressor design having a noise reduction arrangement which concentrates noise reduction in a frequency band corresponding to the bulk of noise produced by a particular rotary compressor.

Another object of the present invention is to provide a noise reduction or attenuation technique which may be easily implemented by a simple machine steps in a previously used part such that manufacture requires only a few additional steps and assembly may be accomplished without additional assembly steps.

Yet another object of the present invention is to provide a rotary compressor avoiding or minimizing the problems noted above with respect to prior designs.

The above and other objects of the present invention which will become more apparent as the description proceeds are realized by a rotary compressor comprising a compression chamber having a cylindrical housing. A roller is mounted for eccentric rotation within the cylindrical housing. A discharge port communicates with the compression chamber. A resonator of the branch type communicates with the compression chamber. The resonator is a Helmholtz resonator having a bandwidth centered at within 20% of 4 kHz. The Helmholtz resonator has a cavity of volume V, and a passage having length l and cross-sectional area $S_b$. The passage extends to the cavity. The square root of V in $mm^{3/2}$ multiplied by $0.125/mm^3$ is within k percent of the square root of $S_b/1\ mm^2$, where k is not greater than 10%. More preferably, k is not greater than 5%. The Helmholtz resonator provides at least 10 dB noise reduction over a bandwidth of within 110% of one-third octave and centered within 20% of 4 kHz. The cavity is a cylindrical cavity having an axis parallel to a rotation axis of the roller. The Helmholtz resonator communicates with the compression chamber by way of the discharge port. The compressor further comprises and end wall at one end of the cylindrical housing, the end wall having an inner surface including a first portion radially within the cylindrical housing and a second portion radially outside of the cylindrical housing. The cavity is on the second portion of the inner surface and is bounded on one side by the cylindrical housing. The passage is on the inner surface and is bounded on one side by the cylindrical housing. The volume V is greater than 50 $mm^2$ and less than 60 $mm^2$. The cavity has a diameter and a length in the axial direction and the diameter is greater than the length. As used herein, an octave shall have its usual meaning such that an octave centered at frequency F extends from $F/2^{\frac{1}{2}}$to $F\cdot 2^{\frac{1}{2}}$, whereas a $\frac{1}{3}$ octave centered at F has the usual meaning of the frequency range between $F/(3/2)^{\frac{1}{2}}$ to $F\cdot(3/2)^{\frac{1}{2}}$ and $2^{\frac{1}{2}}$ of course is the square root of 2.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 9 is a table relating the noise reduction at various frequencies to resonator parameters; and FIG. 10 is a table showing various dimensions which might be used for the cavity of the resonator according to the present invention.

DETAILED DESCRIPTION

Figure 1:
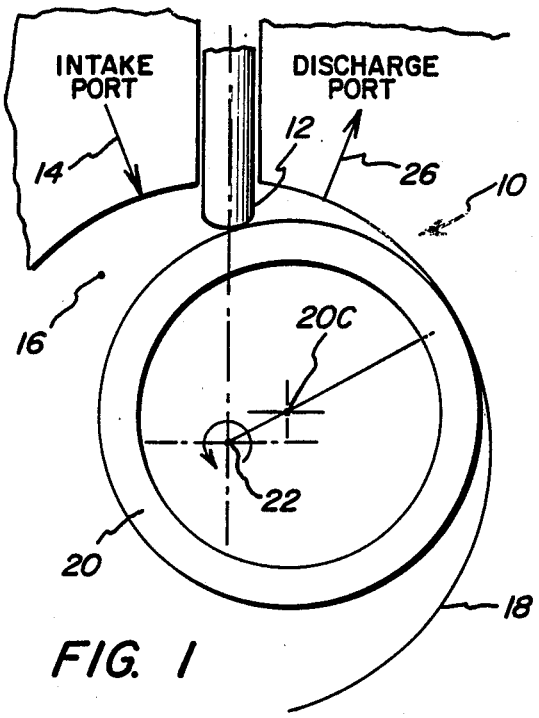
FIG. 1 is a schematic of a compressor according to the present invention.

As shown in the schematic of FIG. 1, a rotary compressor 10 includes a sliding vane 12. Refrigerant gas enters through an intake port 14 (shown schematically) into a chamber 16 within cylindrical chamber wall 18 (only partially shown). A roller 20 having a center 20C rotates eccentrically about shaft center 22. The shaft (not shown) drives the roller 20 and is rotatably mounted within two end walls (not shown) in known fashion. As the roller 20 rotates, the refrigerant gas is compressed in a portion 24 within the chamber 16. When the refrigerant gas is sufficiently compressed, a discharge valve (not separately shown) associated with the discharge port 26 (illustrated schematically) opens such that the high pressure refrigerant gas passes through the refrigerator and circulates.

As the overall operation of the compressor 10 is relatively well known and the present invention relates to use of a particular noise attenuation arrangement in connection with such a rotary compressor, the discussion herein will concentrate on the operation of the noise attenuation arrangement.

Figure 3:
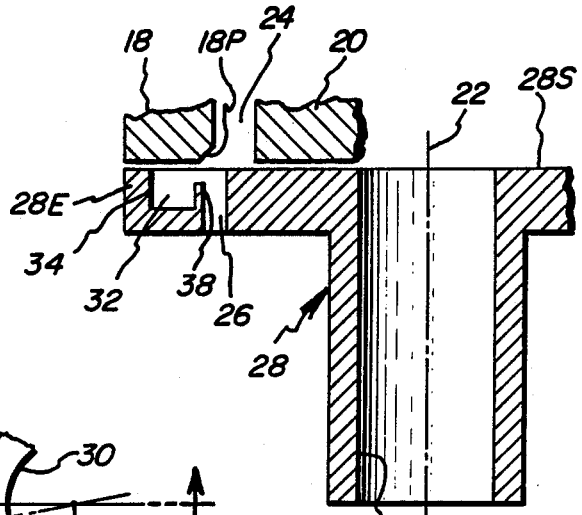
FIG. 3 is a cross-section taken along lines 3—3 of FIG. 2.
Figure 2:
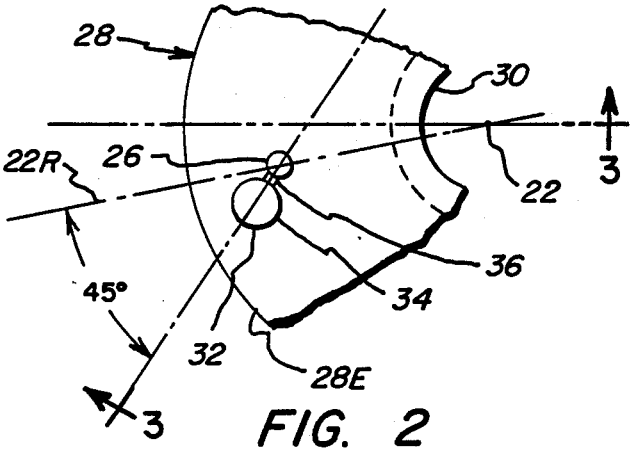
FIG. 2 is an enlarged planar view of a portion of an end wall according to the present invention.

With reference now to the planar view of FIG. 2 showing a portion of end wall 28 and the cross-section view of FIG. 3, a discharge port 26 extends within the end wall 28. The discharge port 26, which is preferably cylindrical, extends lengthwise parallel to an axis of shaft rotation 22. The end wall receives a shaft (not shown) within cylindrical cavity 30, the shaft being used to drive the roller 20 about axis 22 while the end wall 28 and cylinder wall 18 remain stationary.

Although the end wall 28 could include an intake port (such as 14 illustrated schematically in FIG. 1), such an intake port is not shown in the views of FIGS. 2 and 3.

Figure 4:
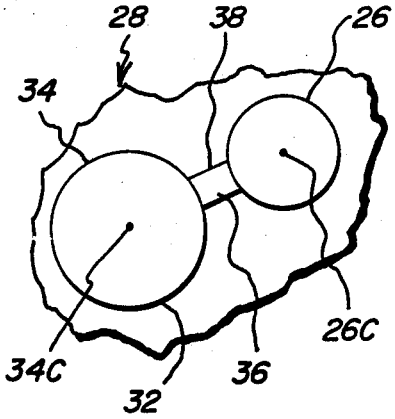
FIG. 4 shows an enlarged view of the discharge port and resonator as mounted in the end wall.

Continuing to view FIGS. 2 and 3, but also considering the view of FIG. 4, the discharge port 26 is connected to a resonator 32 having a cylindrical cavity 34 with an axis of symmetry 34C and a passage 36. The resonator 32 is a Helmholtz resonator. The passage 36 (labeled in FIG. 4 only) is preferably square in cross-section and centered about a line extending between center axis 34C of cavity 34 and a parallel central axis 26C of discharge port 26. Both central axis 34C and central axis 26C are parallel to axis 22 and the roller center axis 20C (20 C in FIG. 1 only). A wall 38 (FIG. 3 only) may be used to separate out a portion of cavity 34 of the resonator 32 from the discharge port 26. The end wall or plate 28 has an inner surface 28S with a first portion radially within cylindrical wall 18 and a second portion radially outside the inner wall of cylindrical wall 18. The cavity 34 is on the second portion of inner surface 28S and is bounded by the cylindrical wall 18.

The compressor 10 is identical to a known design except for the addition of the resonator 32 having the specific characteristics discussed below. The resonator 32 will attenuate or reduce the noise of the compressor significantly, especially in a frequency band centered at or around 4 kHz corresponding to a band of high noise for the compressor. Specifically, the cavity 34 of resonator 32 communicates with the portion 24 of chamber 16 by way of the discharge port 26. As shown, the cylindrical wall 18 may have a portion 18P which is cut out to better allow communication with the discharge port 26. The resonating cavity 34 of the Helmholtz resonator 32 significantly diminishes the noise. The present invention maximizes the attenuation of the noise without requiring additional parts beyond those previously used for this rotary type of compressor. In particular, the cylindrical cavity 34 may easily be drilled or otherwise machined from the end plate 28. Use of a cylindrical cavity for the cavity 34 is advantageous in that the machining of such a cavity is very simple. Additionally, one would then use a simple grinding stone or other very straightforward machining step to cut the rectangular passage 36 between the discharge port 26 and the cavity 34.

The discharge port 26 may have a diameter of 2 mm and a length of 6 mm. The wavelength of a 4 kHz sound wave should be about 3.5 centimeters at a crank angle of 270°. (The speed of sound for a refrigerant gas is about 140 meters/second when the chamber pressure is 200 psi and the temperature is 300° F.)

When the resonator is designed to attenuate 4 kHz, there is a unique relationship between the volume of the cavity V, the length of the passage 1, and the cross-sectional area $S_b$ of the passage. The relationship is shown graphically by FIG. 5, which represents a specific application (based upon the chamber conditions such as speed of sound, temperature, and pressure) of more generally known relationships of parameters of a Helmholtz resonator and illustrates how a Helmholtz resonator can obtain a resonant frequency of 4 kHz using different values for the volume V. As shown by the curve 40 of FIG. 5, the square root of V in $mm^{3/2}$ multiplied by approximately $0.125/mm^3$ is within K percent of the square root of $S_b/1$ in $mm^{\frac{1}{2}}$ where k is not greater than 10% and, more specifically, k is not greater than 5%. In the preferred embodiment, the first calculated quantity (0.125 square root of V) is equal to the second calculated quantity (square root of $S_b/1$).

Figure 6:
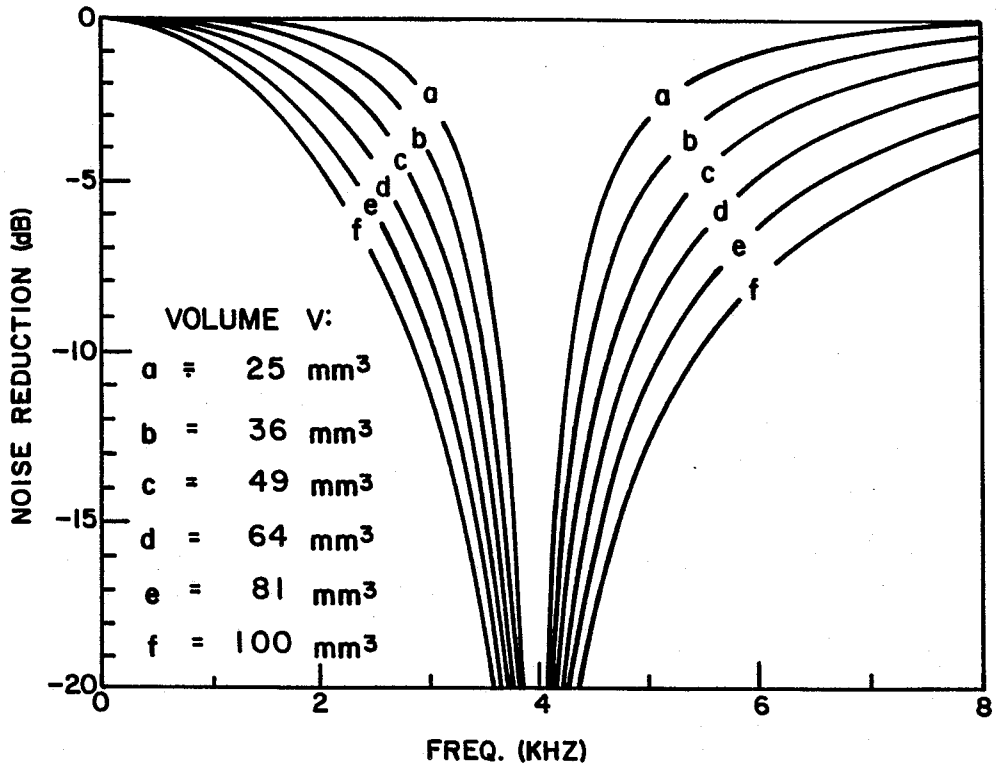
FIG. 6 shows noise reduction characteristics of various resonators according to the present invention.
Figure 7:
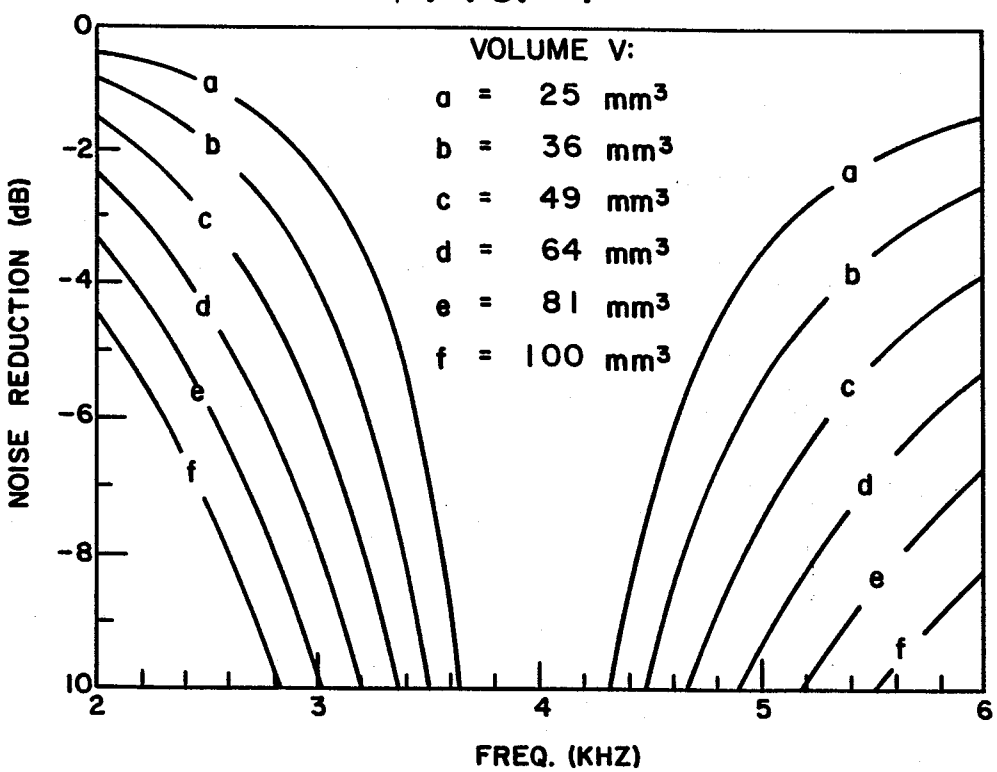
FIG. 7 shows an enlarged or more detailed view of the noise characteristics of FIG. 6.

Considering now the graphs of FIG. 6 and the enlarged graphs of FIG. 7, there are shown six different curves illustrating the relationship between the frequency characteristics and the volume of the Helmholtz resonator. As shown, the larger the volume, the greater the bandwidth of frequency reduction. However, referring back to FIG. 3 and considering that it is desirable to fit the resonator 32 onto and end wall 28, the present invention is designed to allow the use of an appropriate resonator 32 without changing the dimensions of the end wall 28 from its previous design. Therefore, the volume will be limited to that which will fit within the end wall 28 and the proper bandwidth. The constraints upon the resonator 32 are that the surface area of the resonator has to fit on the surface of end plate 28 which contacts the cylindrical wall 18 and the resonator 32 must be disposed radially outward (relative to central axis 22 of the shaft which corresponds to the central axis also of the end wall or plate 28) from the discharge port 26 such that the resonator 32 avoids contact with the moving roller 20.

Figure 5:
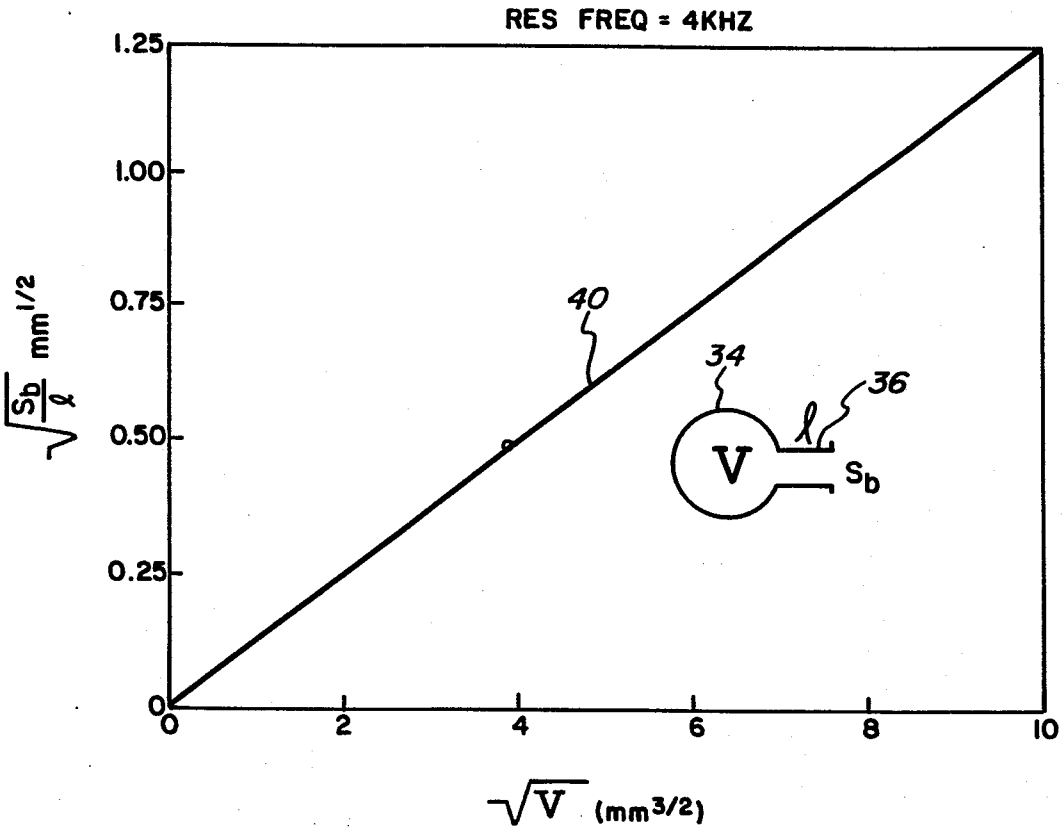
FIG. 5 is a graph illustrating a relationship between parameters of the resonator, which relationship should be maintained to provide the proper noise attenuation according to the present invention, the parameters also being illustrated by a schematic of the resonator under the curve in this FIG.
Figure 8:
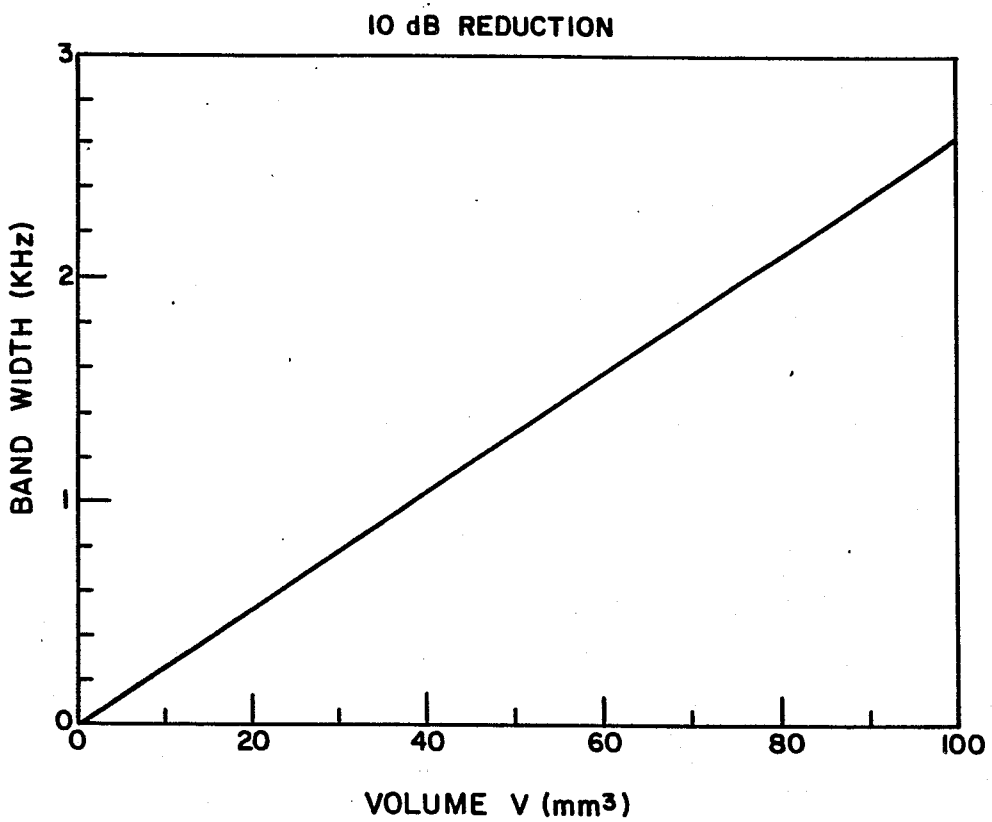
FIG. 8 shows a relationship between the bandwidth corresponding to a 10 dB noise reduction and the volume of the resonator according to the present invention.

FIG. 8 shows the relationship between the volume of the cavity and the bandwidth having 10 dB noise reduction, generally illustrating the variations between the different curves of FIGS. 6 and 7, and relating to a resonator satisfying the relationship of FIG. 5.

With reference now to FIG. 9, the attenuation of the noise at various frequencies is listed for various volumes of a resonator arrangement satisfying the relationship of FIG. 5. As shown in FIG. 9, a one-third octave band of 10 dB noise reduction centered at 4 kHz can be achieved by using a volume having a square root of 7.0 $mm^{3/2}$. More precisely, a 1 kHz bandwidth of 10 dB noise reduction between 3,550 Hz and 4,550 Hz can be obtained by using a resonator volume on the order of 30 $mm^3$ as shown by reference back to FIG. 8. By keeping the cavity volume less than 60 $mm^3$, one can avoid problems which might otherwise occur such as difficulty in fitting the cavity in the end wall 28 or reduced compressor efficiency.

FIG. 10 shows three different models of the resonator which have been constructed and tested. In particular, FIG. 10 shows the dimension of the diameter of cylindrical cavity 34 and different lengths (i.e., direction corresponding to central axis 34C in FIG. 4 and parallel to axis 22 of FIG. 3) of the cavity 34. The volume corresponding to the three different size cylindrical cavities is given in $mm^3$. Actual measured values for noise are significantly reduced by the three different resonators tested. Specifically, the noise of various of the prior compressors without the resonator produced significantly more noise than those three designs having the resonator. Note that the modified design number 2 having a cavity of volume 49.1 $mm^3$ provides approximately 10 dB noise reduction in the 4 kHz band and approximately 5 dB noise reduction overall. The results for modified design 2 and design 3 are sufficiently close that further testing would be required before their noise characteristics can be meaningfully compared.

Momentarily referring back to FIG. 3, it should be noted that the dimensions for cavity 34 corresponding to modification number 2 of FIG. 10 will readily fit between the discharge port 26 and the outer edge 28E of the end wall or plate 28. Because the diameter of the cavity 34 may readily fit in this space to provide the volume corresponding to modification number 2, the cavity 34 may be constructed as a cylinder and need not be constructed as a more complex shape which is harder to machine. Additionally, the length of the cavity 34 for modification number 2 corresponding to FIG. 10 may freely fit within the 6 mm corresponding to the thickness of end wall 28 at the edge 28E, this thickness also corresponding to the length of the discharge port 26. It should be noted that the passage 36 would have a square cross-section each side of which could be, for example, 0.039 inches or about 1.0 mm, whereas the length 1 could be 0.019 inches or 0.48 mm.

Referring back now to FIG. 2, it should also be noted that the passage 36 extends at an angle of 45° relative to a radius 22R centered at the shaft rotation axis 22, which is also the center of end wall 28. By having the resonator 32 mounted at an angle relative to a radius of the end wall, one has more room to fit the surface area of cavity 34 within the space between the discharge port 26 and the outer edge 28E of the end wall 28.

Although various specific constructions and details have been discussed herein, it is to be understood that these are for illustrative purposes only. Various modifications and adaptations will be apparent to those of skill in the art. Accordingly, the scope of the present invention should be determined by reference to the claims appending hereto.

What is claimed is:

1. A rotary compressor comprising:

a compression chamber having a cylindrical housing:

a roller mounted for eccentric rotation within said cylindrical housing;

a discharge port communicating with said compression chamber; and a resonator of the branch type, said resonator communicating with said compression chamber and being Helmholtz resonator having a bandwidth centered at within 20% of 4 kHz, and;

wherein said Helmholtz resonator has a cavity of volume V, and a passage having length 1 and cross-sectional area $S_b$ and a passage extending to the cavity, and wherein the square root of V in $mm^{3/2}$ multiplied by $0.125/mm^3$ is within k percent of the square root of $S_b/1$ $mm^{\frac{1}{2}}$, where k is not greater than 10%.

2. The rotary compressor of claim 1 where k is not greater than 5%.

3. The rotary compressor of claim 2 wherein the Helmholtz resonator provides at least 10 dB noise reduction over a bandwidth of within 110% of one-third octave and centered within 20% of 4 kHz.

4. The rotary compressor of claim 3 wherein said cavity is a cylindrical cavity having an axis parallel to a rotation axis of said roller.

5. The rotary compressor of claim 4 wherein said Helmholtz resonator communicates with said compression chamber by way of said discharge port.

6. The rotary compressor of claim 5 further comprising an end wall at one end of said cylindrical housing, said end wall having an inner surface including a first portion radially within said cylindrical housing and a second portion radially outside of said cylindrical housing, and wherein said cavity is on said second portion of said inner surface and is bounded on one side by said cylindrical housing.

7. The rotary compressor of claim 6 wherein said passage is on said inner surface and is bounded on one side by said cylindrical housing.

8. The rotary compressor of claim 1 further comprising an end wall at one end of said cylindrical housing, said end wall having an inner surface including a first portion radially within said cylindrical housing and a second portion radially outside of said cylindrical housing, and wherein said cavity is on said second portion of said inner surface and is bounded on one side by said cylindrical housing and wherein said passage extends at an angle relative to a radius drawn from a rotation axis of said roller.

9. The rotary compressor of claim 8 wherein said passage is on said inner surface and is bounded on one side by said cylindrical housing.

10. The rotary compressor of claim 9 wherein k is not greater than 5%.

11. The rotary compressor of claim 9 wherein V is on the order of 30 $mm^2$ and less than 60 $mm^3$.

12. The rotary compressor of claim 11 wherein said cavity is a cylindrical cavity having an axis parallel to said rotation axis of said roller.

13. The rotary compressor of claim 12 wherein said cavity has a diameter and a length in the axial direction and said cavity diameter is greater than said cavity length.

14. The rotary compressor of claim 1 wherein said cavity is a cylindrical cavity having an axis parallel to a rotation axis of said roller.

15. The rotary compressor of claim 14 further comprising an end wall at one end of said cylindrical housing, said end wall having an inner surface including a first portion radially within said cylindrical housing and a second portion radially outside of said cylindrical housing, and wherein said cavity is on said second portion of said inner surface and is bounded on one side by said cylindrical housing and wherein said passage is on said inner surface and is bounded on one side by said cylindrical housing.

16. The rotary compressor of claim 15 wherein said cavity has a diameter A and a length in the axial direction B and A is greater than B.

17. The rotary compressor of claim 1 wherein V is on the order of 30 $mm^2$ and less than 60 $mm^3$.

18. The rotary compressor of claim 17 wherein said cavity is a cylindrical cavity having an axis parallel to a rotation axis of said roller.

19. The rotary compressor of claim 18 further comprising an end wall at one end of said cylindrical housing, said end wall having an inner surface including a first portion radially within said cylindrical housing and a second portion radially outside of said cylindrical housing, and wherein said cavity is on said second portion of said inner surface and is bounded on one side by said cylindrical housing and wherein said passage is on said inner surface and is bounded on one side by said cylindrical housing and wherein said passage extends at an angle of 45° relative to a radius drawn from a rotation axis of said roller.

20. The rotary compressor of claim 19 wherein k is not greater than 5%.

* * * * *